United States Patent [19]

Urushidani

[11] Patent Number: 4,516,551

[45] Date of Patent: May 14, 1985

[54] CONTROL SYSTEM FOR IGNITION TIMING AND EXHAUST GAS RECIRCULATION OF COMBUSTION ENGINE

[75] Inventor: Masahiro Urushidani, Toyota, Japan

[73] Assignee: Toyota Jidosha Kabushiki Kaisha, Toyota, Japan

[21] Appl. No.: 450,374

[22] Filed: Dec. 16, 1982

[51] Int. Cl.[2] ..... F02P 5/04

[52] U.S. Cl. ..... 123/407; 123/568; 123/588; 123/328

[58] Field of Search ..... 123/568, 407, 409, 571, 123/328

[56] References Cited

U.S. PATENT DOCUMENTS

| | | | |
|---|---|---|---|
| 4,186,697 | 2/1980 | Yasuda | 123/407 |
| 4,191,143 | 3/1980 | Yuuki | 123/407 |
| 4,191,147 | 3/1980 | Yuuki | 123/407 |
| 4,220,126 | 9/1980 | Tomita | 123/407 |
| 4,248,193 | 2/1981 | Choma | 123/568 |
| 4,267,809 | 5/1981 | Mase | 123/568 |
| 4,334,515 | 6/1982 | Otsuka | 123/568 |
| 4,335,690 | 6/1982 | Hosokawa | 123/407 |
| 4,369,752 | 1/1983 | Ito | 123/568 |

*Primary Examiner*—Ronald B. Cox

*Attorney, Agent, or Firm*—Oblon, Fisher, Spivak, McClelland & Maier

[57] ABSTRACT

A control system for ignition timing and exhaust gas recirculation which includes a vacuum controller operated by a power source of negative pressure to advance the ignition timing, an EGR valve operated by a power source of negative pressure to recirculate the exhaust gas, a temperature sensing valve sensing an engine temperature which introduces atmosphere to the vacuum controller as well as to the EGR valve when the engine temperature is low, a pressure control valve which introduces the atmosphere by a flow ratio substantially in inverse proportion to a pressure of the exhaust gas, and a negative pressure line which introduces a negative pressure at a portion in a carburetor at an upstream side from a throttle valve to the vacuum controller and the EGR valve, whereby the vacuum controller and the EGR valve are controlled in connection with each other.

6 Claims, 4 Drawing Figures

CONTROL SYSTEM FOR IGNITION TIMING AND EXHAUST GAS RECIRCULATION OF COMBUSTION ENGINE

BACKGROUND OF THE INVENTION

1. Field of the Invention

The present invention relates to a control system for ignition timing and exhaust gas recirculation of a combustion engine, and more particularly to a control system including a vacuum controller which is operated by a power source of negative pressure of a passageway of a carburetor to advance the ignition timing, and a controller having an EGR valve (exhaust gas recirculation valve) which is operated by a power source of the negative pressure to recirculate the exhaust gas into the intake manifold of the engine.

2. Description of the Prior Art

The conventional control system of this kind independently controls the vacuum controller and the EGR valve from each other. While the control system controls both of the ignition timing and the exhaust gas recirculation according to common information of an engine temperature, both the ignition timing and exhaust gas recirculation are also controlled independently from each other. It is necessary to control the ignition timing according to the condition of the exhaust gas recirculation, because optimum ignition timing depends upon the condition of the exhaust gas recirculation. Accordingly, the conventional control system is unable to perform a precise control of the ignition timing as well as the exhaust gas recirculation.

SUMMARY OF THE INVENTION

The object of the present invention is to provide a control system which controls the ignition timing and the exhaust gas recirculation in connection with each other.

According to the present invention, the negative pressure is introduced to the vacuum controller and the EGR valve from a common negative pressure line through a pressure control valve which introduces the atmosphere thereto substantially in inverse proportion to a pressure of the exhaust gas, so as to control the vacuum controller according to the difference between the negative pressure in the negative pressure line and the atmosphere introduced to the pressure control valve.

Various other objects, features and attendant advantages of the present invention will be more fully appreciated as the same becomes better understood from the following detailed description when considered in connection with the accompanying drawings in which like reference characters designate like or corresponding parts throughout the several views and wherein:

DETAILED DESCRIPTION OF PREFERRED EMBODIMENTS

Figure 1:
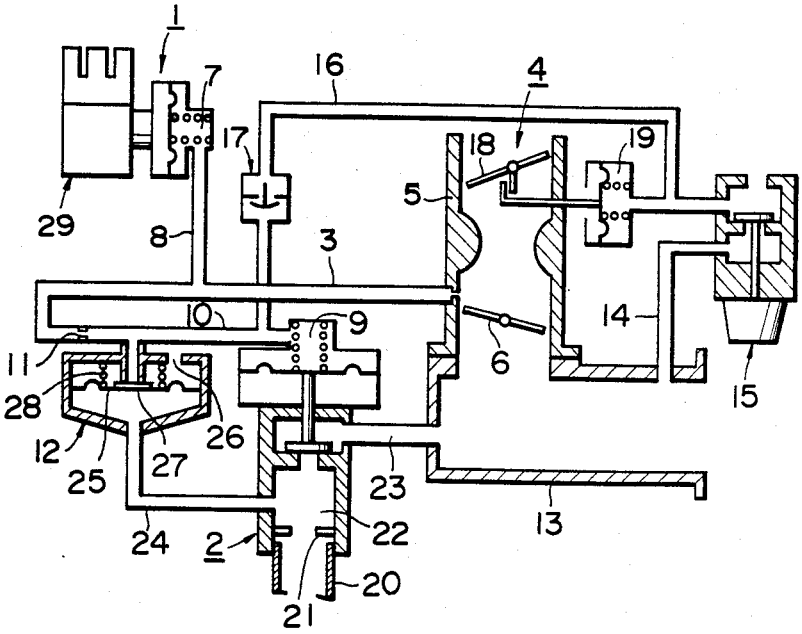
FIG. 1 shows the first embodiment of the present invention.

As shown in FIG. 1, the control system for ignition timing and exhaust gas recircuration includes a vacuum controller 1 which is operated by a power source of negative pressure to advance ignition timing and an EGR valve 2 which is operated by a power source of the negative pressure in a passageway of a carburetor to control the recirculation of the exhaust gas into a intake manifold. The vacuum controller 1 and the EGR valve 2 are communicated through a negative pressure line 3 with a portion of air passageway 5 in a carburetor 4 at an upstream side from a throttle valve 6. The negative pressure line 3 has a line 8 to a negative pressure chamber 7, and a line 10 diverging from the line 8 to a negative pressure chamber 9 of the EGR valve 2. The line 10 is provided therein with throttle 11. The line 10 is connected at a portion between the throttle 11 and the chamber 9 with a pressure control valve 12, which introduces the atmosphere to the line 10.

An intake manifold 13 communicated with the passageway 5 is connected with a temperature sensing valve 15 through a line 14. The valve 15 is connected with a line 16 leading to the line 10 at a portion between the throttle 11 and the chamber 9. The valve 15 senses an engine temperature so as to close the line 14 and introduces the atmosphere to the line 16 when the engine temperature is low, and so as to communicate the lines 14 and 16 for introducing the negative pressure of the intake manifold 13 into the line 16 when the engine temperature is high. The line 16 is provided with a check valve 17 preventing a flow toward the valve 15. The valve 17 is closed when the negative pressure in the intake manifold 13 is introduced to the line 16. The valve 17 is opened to introduce the atmosphere to the line 10 when the atmosphere is introduced through the valve 15 to the line 16.

At a portion upstream from the throttle valve 6 in the air passageway, there is provided a choke valve 18 which is opened by a choke valve release device 19 operated by a power source of the negative pressure in the line 16. The choke valve is closed when the atmosphere is introduced to the line 16, or the engine temperature is low, and is closed when the engine temperature is high.

The EGR valve 2 recirculates exhaust gas, which is introduced from an exhaust gas introducing line 20 through a throttle 21 to a pressure chamber 22, from a line 23 to the intake manifold 13. The EGR valve performs this recirculation when the negative pressure in the chamber 9 reaches a value greater than a specified value.

The valve 12 is communicated with the chamber 22 through a line 24 and contains a diaphragm 25 acutuated by exhaust gas pressure in the chamber. The valve 12 also has a port 26 for introducing atmospheric pressure and a valve seat 27 adapted to communicate the port 26 to the line 10, so that the communication between the line 10 and the port 26 is shut off when the diaphragm 25 comes into abutment to the valve seat 27 by the exhaust gas pressure. A spring 28 is also housed in the valve 12 such that the spring detaches the diaphram 25 from the valve seat 27, when the exhaust gas pressure becomes great enough, whereby the line 10 is communicated with the port 26.

The vacuum controller 1 controls the distributor 29 according to the negative pressure in the chamber 7, so that the higher the negative pressure in the chamber 7 becomes, the more the ignition timing is advanced.

The operation of the control system is as follows:

(I) When the engine temperature is low;

The atmosphere is introduced through the valve 15, line 16 and valve 17 to the line 10 so that the pressure in the chamber 9 becomes atmospheric pressure, then the exhaust gas is prevented from recirculation into the intake manifold 13. At the same time the atmosphere is introduced through the valve 15 to the device 19 to prevent the device 19 from performing, then valve 18 is kept closed. Therefore, the mixture of gasoline and air is rich enough to drive the engine with good performance.

The negative pressure in the passageway 5 is introduced to the the line 8, to which a small portion of the atmosphere is introduced through the line 16, valve 17, line 10 and throttle 11, so that the pressure in the chamber 7 becomes slightly negative, whereby the ignition timing is slightly retarded and the exhaust gas is kept clean.

Figure 2:
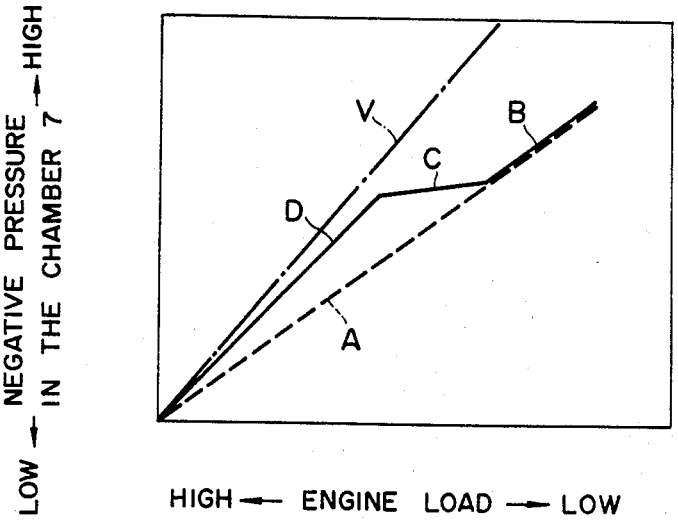
FIG. 2 shows a diagram of the relationship between engine load and negative pressure in the vacuum controller.

As shown by a broken line A in FIG. 2, when the engine temperature is low, the higher the engine load increases, and the lower the negative pressure in the chamber 7 becomes. As also shown by a broken line a in FIG. 3, when the engine temperature is low, the negative pressure in the chamber 9 is fairly low having no connection with the engine load.

(II) When the engine temperature is high;

The valve 15 introduces the negative pressure in the intake manifold 13 through the line 14 to the line 16, and the negative pressure closes the valve 17. The valve 15 introduces the negative pressure in the intake manifold 13 also to the device 19, so that the valve 18 is opened.

The control system operates three ways in connection with the engine load, as follows;

(1) When the engine load is low;

The pressure of the exhaust gas gradually increases as the engine load becomes higher. When the engine load is low, the pressure of the exhaust gas against diaphragm 25 of the valve 12 is also low, so that valve seat 27 is opened and the atmosphere is introduced through port 26 to line 10. The atmosphere is further introduced to the chamber 9 so as to prevent the recirculation of the exhaust gas into the intake manifold.

A small portion of the atmosphere introduced to the line 10 flows through the throttle 11 into the line 8, into which the negative pressure in the passageway 5 is introduced. Therefore the ignition timing is slightly retarded in a manner substantially the same as the ignition timing of the low engine temperature.

As shown by a solid line B in FIG. 2, the higher the engine load becomes, the lower the negative pressure in the chamber 7 becomes. As additionally shown by a solid line b in FIG. 3, the negative pressure in the chamber 9 is fairly low having no connection with the engine load.

(2) When the engine load increases;

The pressure of the exhaust gas against the diaphragm 25 increases as the engine load increases, and at last pushes the diaphragm 25 against the force of the spring so as to lower the opening ratio of the seat 27. Therefore the negative pressure in the chambers 7 and 9 increases to some extent but does not reach a value great enough to perform the recirculation of the exhaust gas into the intake manifold 13. The vacuum controller advances the ignition timing according to the negative pressure in the chamber 7.

As shown by a solid line C in FIG. 2, the negative pressure in the chamber 7 has little connection with the engine load. As also shown by a solid line C in FIG. 2, the higher the engine load becomes, the higher the negative pressure in the chamber 9 becomes.

(3) When the engine load is high;

When the engine load is high, the pressure of the exhaust gas against the diaphragm 25 becomes high enough to push the diaphragm so as to close the seat 27. Then the negative pressure in the passageway 5 is directly introduced to the chamber 7 and 9, so that the ignition timing is fairly advanced and the exhaust gas is recirculated into the intake manifold 13 according to the negative pressure in the chamber 9.

As shown by a solid line D in FIG. 2, the higher the engine load becomes, the lower the negative pressure in the chamber 7 becomes. As further shown by a solid line d in FIG. 3, the negative pressure in the chamber 9 slightly increases as the engine load becomes higher.

It will be apparent from the above descriptions (I) and (II) that when the engine temperature is low, or the choke valve is not in operation, the exhaust gas is not recirculated and the ignition timing is controlled so as to be retarded to some extent. As a result, the exhaust gas is kept clean without deteriorating the driving performance. Furthermore, when the engine temperature is high, or the choke valve is released, the ignition is retarded to some extent so far as the engine load is low and the exhaust gas is not recirculated, and the ignition timing is fairly advanced so far as the engine load is in the middle range and the exhaust gas is recirculated. Therefore, the exhaust gas is kept clean without deteriorating the efficiancy of the engine.

It will be also apparent that the ignition timing and the exhaust gas recirculation are controlled in connection with each other, because both the vacuum controller 1 and the EGR valve 2 are controlled by the common temperature sensing valve 15, negative pressure line 3 and pressure control valve 12.

Figure 3:
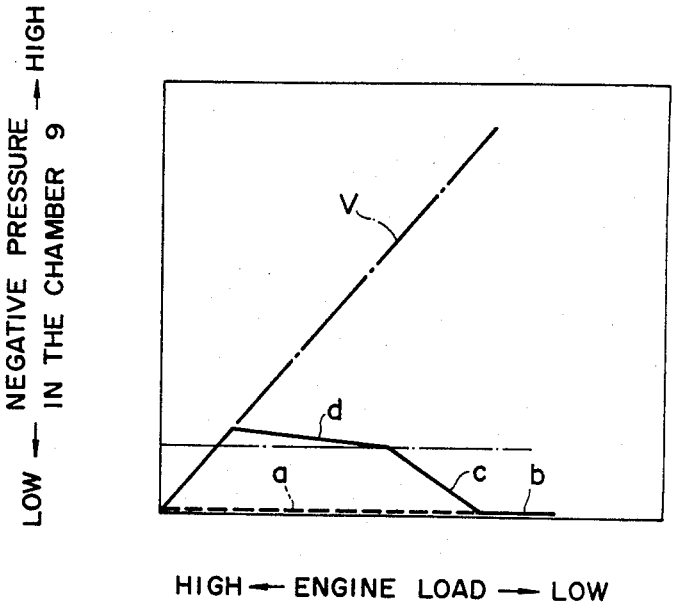
FIG. 3 shows a diagram of the relationship between engine load and negative pressure in the EGR valve.

In FIGS. 2 and 3, one-dot chain lines V shows the negative pressure in the air passageway 5.

Figure 4:
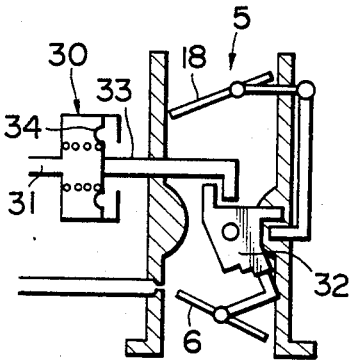
FIG. 4 partially shows the second embodiment of the present embodiment.

FIG. 4 shows the second embodiment, in which in place of the choke valve release device 19 a fast idle release device 30 is employed, which is communicated with the temperature sensing valve (not shown) through a line 31.

A first idle cam 32 is connected with the throttle valve 6, and the device 30 includes a lever 33 for driving the cam 32 and a diaphragm 34 for driving the lever 33. When the engine temperature is high, the negative pressure in the intake manifold is introduced through the temperature sensing valve (not shown) to the fast idle release device, which drives the diaphragm 34 and the lever 33 to rotate the cam 32 in a direction to close the throttle valve 6.

As described above, the control system for the ignition timing and the exhaust gas recirculation of the present invention is able to control the ignition timing and the exhaust gas recirculation in connection with each other by a simple arrangement, because the negative pressure is introduced to the vacuum controller and the EGR valve from the common negative pressure line through the common pressure control valve, which introduces the atmosphere to the vacuum controller and the EGR valve substantially in proportion to the pressure of the exhaust gas so that the ignition timing is controlled according to the difference between the the negative pressure in the negative pressure line and the atmosphere in the pressure control valve.

What is claimed is:

1. A control system for ignition timing and exhaust gas recirculation of a combustion engine having a throttle valve in a carburetor, comprising:

a vacuum controller operated by negative pressure of an air passageway of said carburetor to advance the ignition timing;

an EGR valve operated by said negative pressure to recirculate the exhaust gas;

a temperature sensing valve for sensing an engine temperature which introduces atmosphere to said vacuum controller as well as to said EGR valve when the engine temperature is low;

a pressure control valve which introduces the atmosphere by a flow ratio substantially in inverse proportion to a pressure of the exhaust gas;

a negative pressure line which introduces said negative pressure at a portion in a carburetor upstream of said throttle valve to said vacuum controller and said EGR valve; and a check valve provided in a line from said temperature sensing valve to said negative pressure line, said check valve closing when said temperature sensing valve introduces said negative pressure to said line from said temperature sensing valve to said negative pressure line.

2. A control system for ignition timing and exhaust gas recirculation of a combustion engine having a throttle valve in a carburetor, comprising:

a vacuum controller for controlling the ignition timing operated by negative pressure of an air passageway of said carburetor;

an EGR valve for controlling the exhaust gas recirculation by said negative pressure;

a single negative pressure line communicated with said vacuum controller and said EGR valve to introduce to said vacuum controller and to said EGR valve said negative pressure upstream of said throttle valve;

a temperature sensing valve for sensing an engine temperature and communicated with said negative pressure line, said temperature sensing valve introducing atmosphere to said vacuum controller and said EGR valve through said negative pressure line when the engine temperature is low; and a pressure control valve communicated to said negative pressure line and introducing the atmosphere to said vacuum controller and said EGR valve through said negative pressure line in inverse proportion to a pressure of an exhaust gas.

3. A control system as claimed in claim 1, wherein said pressure control valve further comprises;

a diaphragm to which the negative pressure is applied on a first surface thereof and the pressure of the exhaust gas is applied on a second surface thereof;

a valve seat facing said first surface of said diaphragm; and a spring biasing said diaphragm from said valve seat against the pressure of the exhaust gas.

4. A control system as claimed in claim 1, wherein said negative pressure line diverges at one point to reach said vacuum controller as well as said pressure control valve, and further comprising throttle means provided in said negative pressure line between said one point and said pressure control valve.

5. A control system as claimed in claim 1, further comprising a choke valve and a choke valve release device actuating said choke valve in a portion in the carburetor upstream of said throttle valve, which closes the choke valve when the engine temperature is low and opens the choke valve when the engine temperature is high.

6. A control system as claimed in claim 1, further comprising a fast idle release device which actuates a choke valve in the carburetor upstream from the throttle valve as well as the throttle valve to release a fast idling condition of the engine when the engine temperature is high.

* * * * *